United States Patent [19]

Graham

[11] Patent Number: 4,461,801

[45] Date of Patent: Jul. 24, 1984

[54] WOVEN ARTICLE AND METHOD OF MAKING THE SAME

[75] Inventor: William T. Graham, Verona, Wis.

[73] Assignee: W. T. Rogers Co., Madison, Wis.

[21] Appl. No.: 335,085

[22] Filed: Dec. 28, 1981

[51] Int. Cl.[3] ..... D03D 29/00

[52] U.S. Cl. ..... 428/224; 28/151; 206/223; 217/122; 428/35; 428/131

[58] Field of Search ..... 28/149, 150, 151, 152; 428/35, 131, 224; 217/122; 206/223

[56] References Cited

U.S. PATENT DOCUMENTS

| | | | |
|---|---|---|---|
| 1,872,281 | 8/1932 | Hanson | 28/150 |
| 2,088,455 | 7/1937 | Witt | 28/150 |
| 2,093,828 | 9/1937 | Carlson | 28/150 |
| 2,799,956 | 7/1957 | Cirole | 28/150 |
| 2,807,859 | 10/1957 | Pearce et al. | 28/150 |
| 2,860,399 | 11/1958 | Bates | 28/150 |
| 4,156,308 | 5/1979 | Gebhart | 428/35 |
| 4,188,983 | 2/1980 | Graham et al. | 28/151 |

*Primary Examiner*—James J. Bell

*Attorney, Agent, or Firm*—Isaksen, Lathrop, Esch, Hart & Clark

[57] ABSTRACT

A method of making a spirally woven article (34) using a weaving starter (1) to facilitate starting the article is disclosed. The weaving starter (1) has a central opening (2), a plurality of secondary openings (4) and a plurality of notches (8) on its outer edge (5). The starter (1) is first covered by wrapping material extending through the central opening (2) after which a coiling material (10) is attached to the starter (1) by loops of the wrapping material (12) looped through the secondary openings (4). The wrapping material (12) is then used to loop together subsequent coils of the coiling material (10).

11 Claims, 8 Drawing Figures

Fig 1
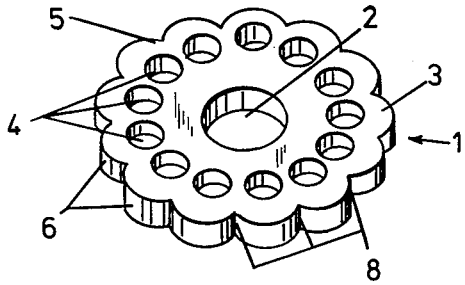
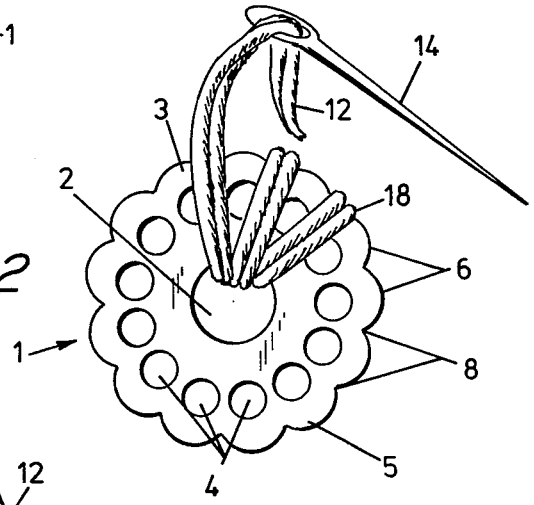
Fig 2
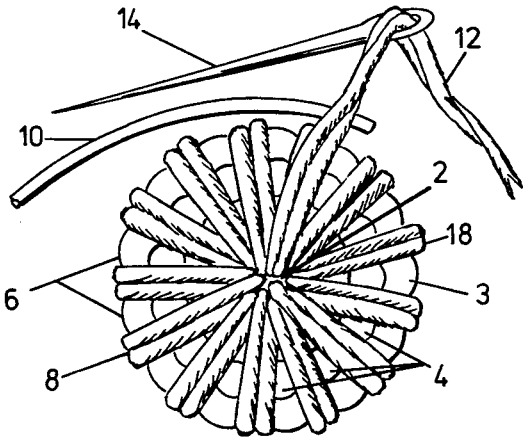
Fig 3
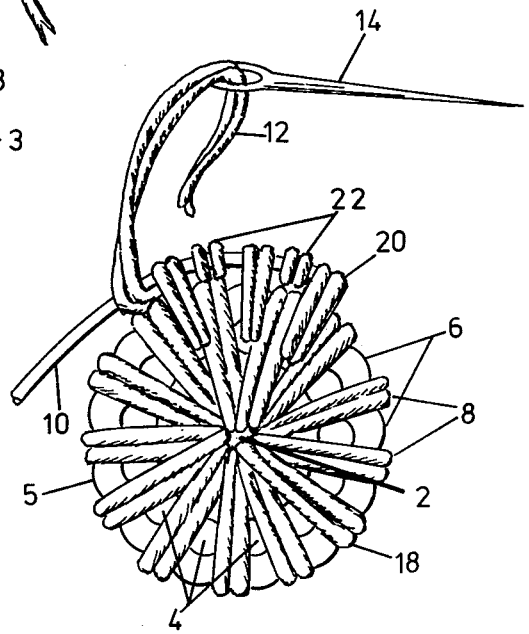
Fig 4

WOVEN ARTICLE AND METHOD OF MAKING THE SAME

TECHNICAL FIELD

The present invention relates to weaving in general, and in particular, to starting woven articles in a manner usable by a novice or hobbyist. In the basket making art, the terms "woven," "weaving," and the like are used generally to include various intertwining, winding, and wrapping techniques. Said terms are so used herein.

BACKGROUND ART

One general type of spiral weaving technique known in the prior art is exemplified by the disclosures of U.S. Pat. Nos. 4,188,983, 1,683,507, 693,911, and 184,237. Generally in this type of technique, the walls and floors of the woven object are made separately. The walls are made by arranging an odd number of vertical struts in a horizontal plate or ring and then strands of coiling material are passed alternately over and under these struts to create an upward spiral. The floor is either solid, with the struts stuck into it, or woven about radial stays, or woven about a hub which has radial spokes.

A second general type of prior spiral weaving technique is exemplified by the disclosure of U.S. Pat. No. 4,156,308. This type of basket is made in one unitary piece. The coiling material is first wound upon itself and gradually spiralled out to form the basket.

Baskets have also been made without any kind of weaving, as in East, U.S. Pat. No. 1,257,823.

The subject of the present invention relates generally to the second type of weaving technique, and to the often difficult process of starting a spirally woven object. Starting such a spirally woven object has been conventionally performed by coiling the material about itself. Alternatively, some weavers have coiled the coiling material around rings to start spirally woven objects. It is a problem with prior techniques that a hole is left in the center of the spirally woven object. Another problem is that it is difficult to start a spirally woven object symmetrically, and it is, therefore, very difficult for a novice or unskilled weaver to start a project in a satisfactory fashion.

SUMMARY OF THE INVENTION

The invention is summarized in a spirally woven article which includes a spiral weaving starter, a coiling material, and a wrapping material, where the spiral weaving start includes a body with a central opening passing completely therethrough. The body has a plurality of secondary openings around the central opening, and also has an outer edge defined about its perimeter. The coiling material is used to spirally weave the framework of the article, while the wrapping material connects the coiling material to the spiral weaving starter.

It is an object of the invention to construct a spirally woven article which can be symmetrically and easily started.

It is a second object of the invention to provide a method for making such a spirally woven article which is suitable for the novice or hobbyist who may have difficulty starting coiling material about itself to start a spiral weaving.

It is yet another object of the invention to provide a device to facilitate the method for making such a spirally woven article.

It is yet another object of the invention to utilize economical, durable materials that the novice or hobbyist will feel at ease in manipulating.

Other objects, advantages, and features of the present invention will become apparent from the following specifications when taken in conjunction with the accompanying drawings.

BRIEF DESCRIPTION OF THE DRAWINGS

FIG. 1 is a perspective view of a spiral weaving starter constructed in accordance with the present invention.

FIG. 2 is a bottom plan view of a step in the method of making a woven object using the spiral weaving starter of FIG. 1.

FIG. 3 is a bottom view of a subsequent step in the method of making a woven object using the spiral weaving starter of FIG. 1.

FIG. 4 is a bottom view of another subsequent step in the method of making a woven object using the spiral weaving start of FIG. 1.

DETAILED DESCRIPTION OF THE PREFERRED EMBODIMENT

Figure 7:
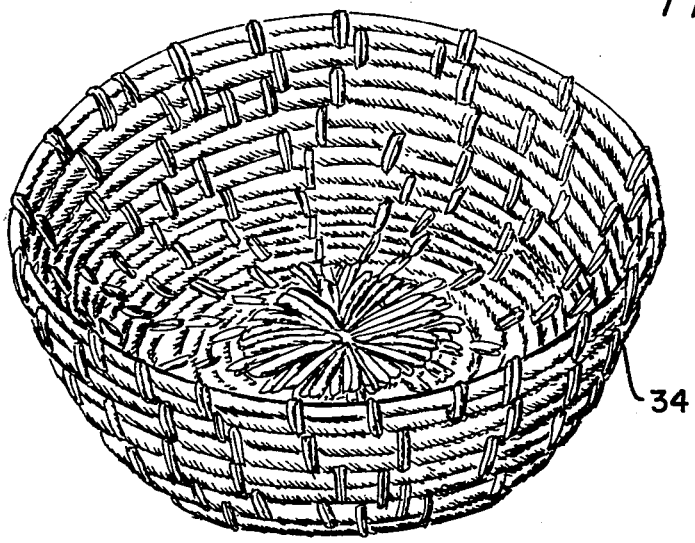
FIG. 7 is a perspective view of a woven object constructed in accordance with the method of FIGS. 2–5.

Shown in FIG. 7 is a spirally woven article, generally indicated at 34, constructed according to the present invention. The construction of the woven article 34 will be described below. That process begins with three main components, a spiral weaving starter 1, constructed according to the present invention, and generally indicated at 1 in FIG. 1, a coiling material 10, and a wrapping material 12. The spiral weaving starter 1 is a flat plate in the shape of a disk or other curved shape and is made of any economical, rigid substance such as wood or thermoplastic resin. The coiling material 10 is a linear flexible filament made of any substance which can be formed into a filament which is sufficiently flexible to bend around the spiral weaving starter 1, yet is sufficiently rigid to form a framework to provide a reasonably rigid shape for the finished spirally woven article 34. Preferably the coiling material 10 is formed from an extruded thermoplastic resin. The wrapping material 12 is preferably a decorative, very flexible multi-stranded material which can be made of any substance which is flexible enough to loop around the strands of coiling material 10 and decorative enough to be an outside covering for the spirally woven article 34. One suitable and preferable material is colored polyester yarn.

The spiral weaving starter 1 illustrated in FIG. 1 has a planar disk-shaped body 3, which, while shown as circular in circumference in the embodiment of FIG. 1, may also be formed in the shape of any closed, preferably symmetrical, closed curve, such as an ellipse or oblong curve. Formed in the geometric center of the body 3 is a central opening 2 having a relatively large diameter and extending completely through the body 3. Formed in a spaced pattern around the central opening 2 are a plurality of secondary openings 4. The secondary openings 4, which are relatively small in diameter, are arranged in a pattern so that they are equally spaced from each other. The pattern in which the secondary openings 4 are arranged is similar to the gemetric shape of the central opening 2 which is also similar to the general geometric shape of the peripheral outer edge 5 of the weaving starter 1, which in this case is circular in shape. While the outer edge 5 has the general geometric shape similar to that of the central opening 2, the detailed shape of the outer edge 5 has a more complex structure. Along the outer edge 5 there are formed a plurality of notches 8 separated by protrusions 6. The number of notches 8, and the thus number of protrusions 6, is equal to the number of secondary openings 4, with the notches 8 being positioned between adjacent secondary openings 4. Thus a line drawn radially outward from the central opening 2 to any notch 8 would pass between a pair of secondary openings 4. The dimensions of the notches 8 and the secondary openings 4 are selected to correspond to the general size of the wrapping material 12 as will be seen below.

To begin the construction of the woven article 34 from its component parts, a length of the wrapping material 12 is first threaded through a needle 14. When threaded, the yarn of the wrapping material 12 should be pulled through the needle 14 sufficiently to form a double strand of material for the subsequent steps.

FIG. 2 shows an initial step in creating the spirally woven article 34 in which the spiral weaving starter 1 is covered with the wrapping material 12. The wrapping material 12 is threaded in alternate loops 18 through the central opening 2 over the outer edge 5 through a respective one of the notches 8, so that a double strand of the wrapping material 12 lies between each pair of adjacent secondary openings 4 on both sides of the spiral weaving starter 1. This process is performed by looping the yarn in order about each of the notches 8 working counterclockwise once around the starter 1. Extra loops 18 of the wrapping material 12 should be added, if necessary, to substantially cover the surface of the spiral weaving starter 1. These extra loops 18 could be added over some or all of the loops 18 created by filling all the notches 8. At the conclusion of this step the central opening 4 should be entirely filled. It is an advantage that the central opening be sized so that it is entirely filled by the wrapping material 12 so that a hole is not left in the middle of the woven article.

FIGS. 3 and 2 show subsequent steps in constructing the spirally woven article 34 in which the coiling material 10 is initially attached to the spiral weaving starter 1. First, the coiling material 10 is laid against the outer edge 5 of the spiral weaving starter 1. The wrapping material 12 is then first looped through a secondary opening 4 over the coiling material 10 and back under the coiling material 10 alone. The wrapping material 12 is then looped back over the coiling material 10 and into and through the next secondary opening 4. A first loop 20 of the wrapping material 12 around the coiling material 10 serves structurally to attach the coiling material 10 to the spiral weaving starter 1 and aesthetically to cover both the coiling material 10 and the remaining exposed surface of the spiral weaving starter 1, between the secondary openings 4 and the outer edge 5, with the wrapping material 12. A second loop 22 of the wrapping material, that which is just looped around the coiling material 10 alone, serves aesthetically to cover the remaining portion of the coiling material (10).

Figure 5:
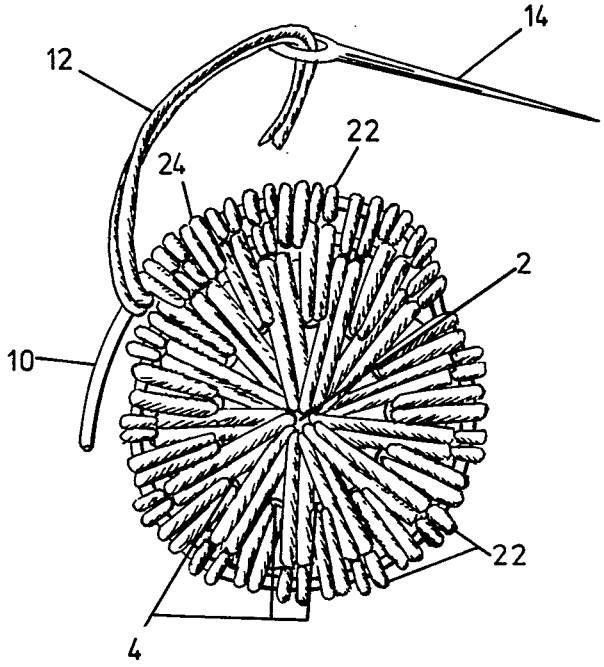
FIG. 5 is a bottom view of yet another subsequent step in the method of making a woven object using the spiral weaving starter of FIG. 1.

FIG. 5 shows another step in making the spirally woven article 34 in which the coiling material 10 is continuously bound to the article in an outward spiral. The wrapping material 12 is alternately looped one or more times over the unattached coiling material 10 alone and is then looped under the next inward coil of the coiling material 10 (which is not shown because it is covered by wrapping material). The loops of the wrapping material 12 labeled 24 in this Figure, those which also wrap around the next inward coil, serve to structurally attach the coiling material 10 to the spirally woven article and aesthetically to cover the coiling material 10. The loops of the wrapping material 12 labeled 22 in this Figure, those which loop only around the coiling material 10, serve aesthetically to cover the coiling material 10.

Figure 6:
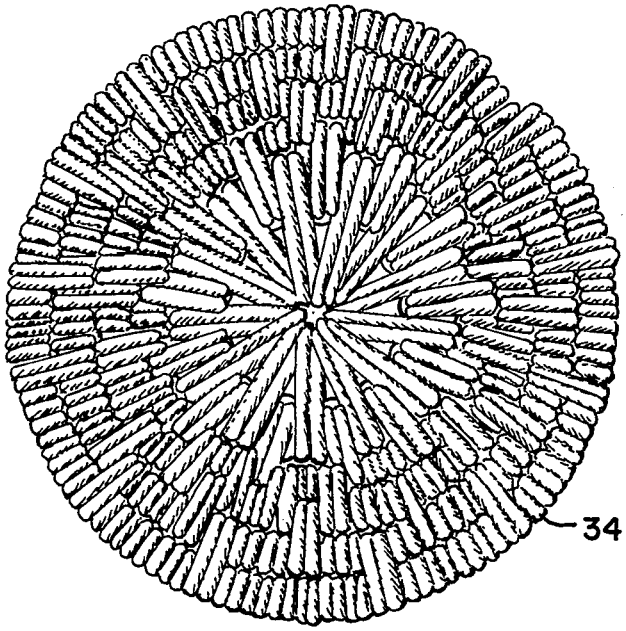
FIG. 6 is a bottom view of the center of the woven object constructed according to the method of FIGS. 2–5.

FIG. 6 shows the center bottom of a spirally woven article 34 made using the spiral weaving starter 1 and using the method described above. It can be seen that the loops in the center of the pattern appear to alternate through the central opening 2 over the notches 18 and through the secondary openings 4 over the coiling material 20, through in fact these loops were not made in this order. It can also be seen that the center is smooth, flat, and substantially symmetrical.

As the article is being woven, additional strands of coiling material 10 may need to be added. This can be done in two ways. The new strand of coiling material 10 can be doubled against the old strand for a short distance as both are attached to the spirally woven article simultaneously by the wrapping material 12, alternatively, if a hollow coiling material 10 is used, a short piece of material of small diameter than the interior of the coiling material 10 can be inserted into the end of the old strand of coiling material 10 and into the beginning of a new strand of coiling material 10 to form a splice. The combination is then attached to the spirally woven article just as a continuous strand of coiling material 10 would be.

Additional strands of wrapping material 12 may be added as needed. The end of the old strand of wrapping material 12 and the beginning of the new strand of wrapping material 12 are both laid against the next unattached portion of the coiling material 10, then the new strand of wrapping material 12 is used to attach all three to the spirally woven article as if they were a single strand of coiling material 10.

The three dimension shape of the woven article 34 can be created by positioning a next coil of the coiling material 10 slightly out of the plane of the previously attached coiling material. As the article starts to take shape, the spacing and sizing of the woven article can be continuously adjusted and controlled by the initial positioning of the coiling material 10. When the spirally woven article 34 has reached the desired size and shape, it can be finished off by tying off the remnant of the wrapping material 12 after the coiling material 10 is completely covered.

FIG. 7 shows the spirally woven article 34 in the form of a woven basket made using the circular spiral weaving starter 1 pictured in FIG. 1

Figure 8:
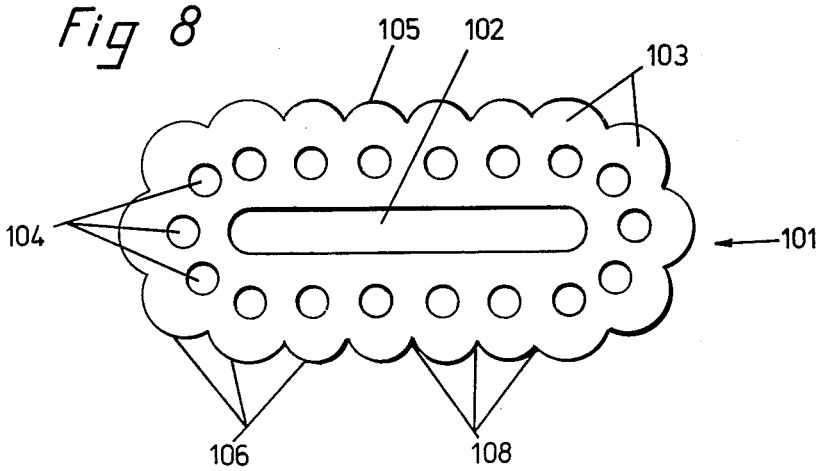
FIG. 8 is a top plan view of an alternative embodiment of a spiral weaving starter constructed in accordance with the present invention.

It is also to be understood that woven articles of different shapes and sizes can be made using differingly sized and shaped starters. for example, shown in FIG. 8 is a weaving starter 101, whose parts are similar to that of the weaving starter 1 of FIG. 1 but whose shape is entirely different. The component parts of the weaving starter 101 have been given reference numerals similar to those of FIG. 1 with 100 added thereto. The weaving starter 101 is oblong in shape and may be used to make a flat elliptical construction, as for a placemat, or an elliptical or oblong basket. Note that the shape of the central opening 102 corresponds to the overall shape of the outer edge 105 of the starter 101 and to the pattern of the secondary openings 104. The secondary openings 104 are still equally spaced from each other. Thus, by using the starter 101, a woven article can be made using the steps shown in FIGS. 2–6 which will be symmetric in design and attractive in appearance with the starter 101 again being completely covered by the wrapping material 12. This process can be easily accomplished by a relatively unskilled person.

Many different sorts of spirally woven articles can be made from the subject of the current disclosure. Examples include baskets, placemats, and coasters. Kits for making such articles can be created containing a spiral weaving starter, coiling material 10 wrapping material 12, and instructions for the benefit of the novice or hobbyist who wishes to make a spirally woven article with a minimum of training. Such a kit might also contain handles for baskets or decorations to be placed on the finished spirally woven object. Different colored wrapping materials can be included for variety.

It is understood that the subject invention is not limited to the particular construction and arrangement of parts disclosed and illustrated herein, but embraces all such modified forms thereof as come within the scope of the following claims.

I claim:

1. A spirally woven article (34) comprising:

a. A spiral weaving starter (1) having a body (3) with a central opening (2) formed therein, a plurality of secondary openings (4) formed therein and arranged in a pattern around the central opening (2), and an outer edge (5);

b. a length of coiling material (10) of linearly flexible filament spirally forming the framework of the article by being coiled around the starter (1); and c. a length of flexible wrapping material (12) wrapped around adjacent coiling material (10) and also wrapped around the coiling material (10) and through the secondary openings (4) in the starter (1), to hold the coiling material in position and to attach it to the starter (1); the wrapping material (12) also wrapped between the central opening (2) and the outer edge (5) of the starter (1) to substantially cover the starter (1) and to fill the central opening (2);

d. a plurality of notches (8) located on the outer edge (5) of the body (3) of the starter (1), there being one notch (8) located between each adjacent pair of the secondary openings (4).

2. A spirally woven article as claimed in claim 1 wherein the wrapping material (12) covers the starter (1) by passing alternately through the central opening (2) and over a one of the notches (8) and through a secondary opening (4) over the coiling material (10) all around the strater (1), whereby a symmetrical center of the article is created.

3. A spirally woven article as claimed in claim 1 wherein the secondary openings in the body (3) of the starter (1) are equally distributed about the central opening (2) in a closed pattern, the closed pattern being similar to the shape of the central opening (4) and also being similar to the general shape of the outer edge (5).

4. A spirally woven article as specified in claim 3 wherein the central opening (2) is a circle and the closed pattern of the secondary openings (4) is a circle and the general form of the articles (34) is circular.

5. A spirally woven article as specified in claim 3 wherein the central opening (2) is oblong and the closed pattern of the secondary openings (4) is oblong and the general form of the article is oblong.

6. A spiral weaving starter (1) to be incorporated as part of a spirally woven article, comprising:

a. a body (3) with a central opening (2) formed therein;

b. the body (3) having a plurality of secondary openings (4) formed therein in a pattern around the central opening (2); and c. the body also having a serrated outer edge (5) including a plurality of notches (8) which are each located such that a line extending radially outward from the central opening (2) to each notch (8) would pass between a pair of adjacent secondary openings (4) so that wrapping material may be looped through the central opening (2) and over the notches (8) on the outer edge (5) of the body without completely covering the adjacent secondary openings (4).

7. A spiral weaving starter as claimed claim 6 wherein the secondary openings (4) are equally distributed in a closed pattern about the central opening (2) similar in shape to and concentric with the central opening (2); and wherein the general shape of the outer edge (5) of the starter (1) is a similar shape so that the center of a completed woven article using the starter (1) will be symmetrical in appearance.

8. A spiral weaving starter as claimed in claim 7 in which the shape of the central opening (2) is a circle and the closed pattern of the secondary openings (4) is also a circle.

9. A spiral weaving starter as claimed in claim 7 wherein the shape of the central opening 12 is an oblong and the closed pattern of the secondary openings (4) is also an oblong.

10. A method for making a spirally woven article incorporating therein a spiral weaving starter, comprising the steps of:

a. looping the flexible wrapping material over a spiral weaving starter (1) having a central opening (2), a plurality of secondary openings (4) arranged in a pattern around the central opening (2) and an outer edge (5) with a plurality of notches (8) which are radially offset with respect to the secondary openings (4), the flexible wrapping material (12) extending back and forth between the central opening (2) and the individual notches (8) in the outer edge (5) of the spiral weaving starter (1) to partially cover the starter (1);

b. attaching a linearly flexible coiling material (10) to the partially covered spiral weaving starter (1) by looping the wrapping material (12) over the coiling material (10) and through the secondary openings (4) in the starter (1); and c. continuing to attach the coiling material (10) in an outward spiral by looping together adjacent coils of the coiling material (10) with the wrapping material (12).

11. A method for making a spirally woven article incorporating therein a spiral weaving starter, as claimed in claim 10, in which the step of attaching the coiling material (10) to the partially covered spiral weaving starter (1) includes the steps of:

a. looping the wrapping material (12) through a secondary opening (4) and over the coiling material (10) to cover a portion of the spiral weaving starter and to attach the coiling material (10) to the covered spiral weaving starter (1);

b. looping the wrapping material (12) at least once around the coiling material (10) alone, whereby the coiling material (10) is substantially covered between points of attachment to the covered spiral weaving starter (1); and c. alternately repeating the two steps above until the coiling material (10) forms at least one coil around the weaving starter (1) and the spiral weaving starter (1) and the attached coiling material (10) are substantially covered by the wrapping material (12).

* * * * *

UNITED STATES PATENT AND TRADEMARK OFFICE

CERTIFICATE OF CORRECTION

PATENT NO. : 4,461,801

DATED : July 24, 1984

INVENTOR(S) : William T. Graham

It is certified that error appears in the above-identified patent and that said Letters Patent are hereby corrected as shown below:

Column 4, line 27 "through" should be --though--;

Column 4, line 68 "for" should be capitalized;

Column 5, line 23 a comma should be inserted after "10";

Column 5, line 46 --coils of the-- should be inserted before "coiling material";

Column 6, line 7 "articles" should be --article--;

Column 6, line 29 --in-- should be inserted before "claim".

Signed and Sealed this

*Twenty-sixth* Day of *February 1985*

[SEAL]

*Attest:*

DONALD J. QUIGG

*Attesting Officer* *Acting Commissioner of Patents and Trademarks*